US011574767B2

(12) United States Patent
Park et al.

(10) Patent No.: US 11,574,767 B2
(45) Date of Patent: Feb. 7, 2023

(54) COIL COMPONENT

(71) Applicant: SAMSUNG ELECTRO-MECHANICS CO., LTD., Suwon-si (KR)

(72) Inventors: Kwang Il Park, Suwon-si (KR); Hye Yeon Cha, Suwon-si (KR); Young Sun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 1008 days.

(21) Appl. No.: 16/294,333

(22) Filed: Mar. 6, 2019

(65) Prior Publication Data

US 2020/0098508 A1 Mar. 26, 2020

(30) Foreign Application Priority Data

Sep. 20, 2018 (KR) ..... 10-2018-0112737

(51) Int. Cl.
*H01F 27/28* (2006.01)
*H01F 27/29* (2006.01)
*H01F 27/32* (2006.01)

(52) U.S. Cl.
CPC ..... *H01F 27/2885* (2013.01); *H01F 27/292* (2013.01); *H01F 27/323* (2013.01)

(58) Field of Classification Search
CPC ... H01F 27/2885; H01F 27/292; H01F 27/323
See application file for complete search history.

(56) References Cited

U.S. PATENT DOCUMENTS

2013/0147592 A1* 6/2013 Yoo ..... H01F 5/003 336/200
2016/0268038 A1* 9/2016 Choi ..... H01F 41/041
(Continued)

FOREIGN PATENT DOCUMENTS

CN 103165259 A 6/2013
CN 107731450 A 2/2018
(Continued)

OTHER PUBLICATIONS

Office Action issued in corresponding Korean Patent Application No. 10-2018-0112737 dated Nov. 15, 2019, with English translation.

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A coil component includes a body having one surface and another surface opposing each other in one direction, a plurality of walls each connecting the one surface to the other surface, and a coil portion disposed therein. A recess extends along at least portions of edges common to the one surface and to walls of the plurality of walls. A lower insulating layer is disposed in the recess and on the one surface. First and second external electrodes penetrate through the lower insulating layer, are spaced apart from each other on the one surface of the body, and are connected to the coil portion. A shielding layer is disposed on the other surface of the body and the plurality of walls of the body, and extends to the one surface of the body to be spaced apart from the first and second external electrodes.

16 Claims, 4 Drawing Sheets

(56) References Cited

U.S. PATENT DOCUMENTS

| | | | | |
|---|---|---|---|---|
| 2017/0110240 | A1* | 4/2017 | Masuda | H01F 27/292 |
| 2017/0256353 | A1* | 9/2017 | Park | C23C 18/1653 |
| 2017/0309576 | A1 | 10/2017 | Kawabata et al. | |
| 2018/0047498 | A1* | 2/2018 | Nakashima | H01F 17/0013 |
| 2018/0166211 | A1 | 6/2018 | Takatsuji | |
| 2018/0277296 | A1* | 9/2018 | Endo | H01F 27/292 |
| 2018/0315545 | A1* | 11/2018 | Kusumoto | H01G 4/38 |
| 2019/0043662 | A1* | 2/2019 | Yamamoto | H01G 4/12 |
| 2019/0318868 | A1* | 10/2019 | Chung | H01F 27/292 |
| 2019/0379343 | A1* | 12/2019 | Miyahara | H01G 4/232 |
| 2020/0082990 | A1* | 3/2020 | Yamamoto | H01F 27/363 |

FOREIGN PATENT DOCUMENTS

| | | | | |
|---|---|---|---|---|
| JP | 2005-310863 | A | | 11/2005 |
| JP | 2017-76796 | A | | 4/2017 |
| JP | 2017-174948 | A | | 9/2017 |
| JP | 2018-98270 | A | | 6/2018 |
| KR | 10-2016-0108935 | A | | 9/2016 |
| KR | 10-2017-0085881 | A | | 7/2017 |
| KR | 20170085881 | A | * | 7/2017 |

OTHER PUBLICATIONS

Dictionary of Plastics Industry, Jiaqi Su, Beijing: Chemical Industry Press, p. 276, Dec. 31, 1989 (English translation Included).

Transient processes and Optimization of Winding Insulation of Power Transformer, Meiyan Wu, Chinese Master's Theses Full-text Database Engineering Science and Technology II, pp. 1-52, Mar. 15, 2017 (English Abstract Included).

* cited by examiner

COIL COMPONENT

CROSS-REFERENCE TO RELATED APPLICATION(S)

This application claims benefit of priority to Korean Patent Application No. 10-2018-0112737 filed on Sep. 20, 2018 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component that can be used together with a resistor and a capacitor in electronic devices.

As electronic devices are designed to have higher performance and to be reduced in size, electronic components used in electronic devices have been increased in number and reduced in size.

Accordingly, there has been increasing demand for removing a factor causing noise such as electromagnetic interference (EMI) in electronic components.

A currently used EMI shielding technique is, after mounting electronic components on a substrate, to envelop the electronic components and the substrate with a shielding can.

SUMMARY

An aspect of the present disclosure is to provide a coil component in which a shielding structure reducing magnetic flux leakage may easily be formed.

Another aspect of the present disclosure is to provide a coil component having reduced size and thickness.

Another aspect of the present disclosure is to provide a coil component in which an electrode structure may easily be formed on a lower surface.

According to an aspect of the present disclosure, a coil component includes a body having one surface and another surface opposing each other in one direction, and a plurality of walls each connecting the one surface to the other surface of the body. An internal insulating layer is disposed in the body, and a coil portion disposed on at least one surface of the internal insulating layer forms at least one turn. A recess is disposed in at least portions of edges between the one surface of the body and the plurality of walls of the body. A lower insulating layer is disposed in the recess and on the one surface of the body. First and second external electrodes penetrate through the lower insulating layer, are disposed on the one surface of the body and are spaced apart from each other, and are connected to the coil portion. A shielding layer is disposed on the other surface of the body and the plurality of walls of the body, and has at least a portion extending to the one surface of the body and spaced apart from the first and second external electrodes.

According to another aspect of the present disclosure, a coil component includes a body including a magnetic material, and having a coil disposed therein, the body having amounting surface, a plurality of side walls, and a stepped edge between the mounting surface and at least one of the plurality of side walls. An insulating layer is disposed on the mounting surface and extends into the stepped edge between the mounting surface and the at least one of the plurality of side walls. First and second external electrodes are disposed on the mounting surface, extend through the insulating layer, and are connected to opposing ends of the coil. A conductive shielding layer may be disposed on a cap surface of the body opposite to the mounting surface and on the plurality of side walls of the body, and may contact the insulating layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
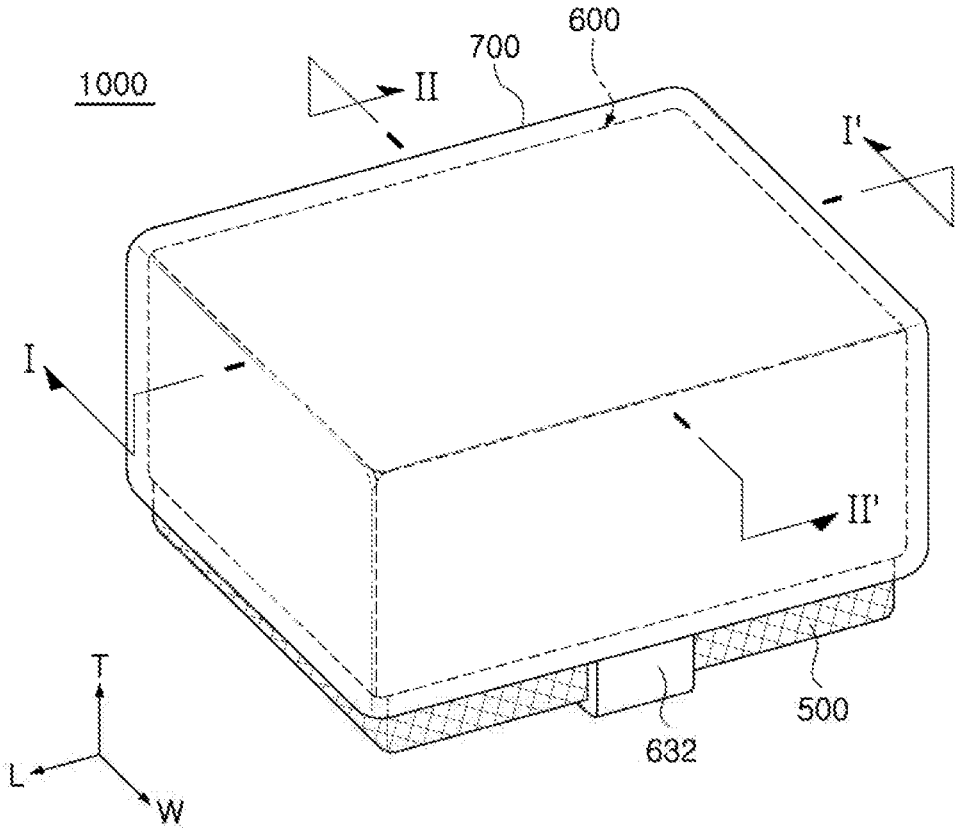
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts, or combination thereof, and do not exclude the possibilities of combination or addition of one or more features, numbers, steps, operations, elements, parts, or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include configurations in which another element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, and a T direction is a third direction or a thickness direction.

In the descriptions of the accompanying drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

Figure 2:
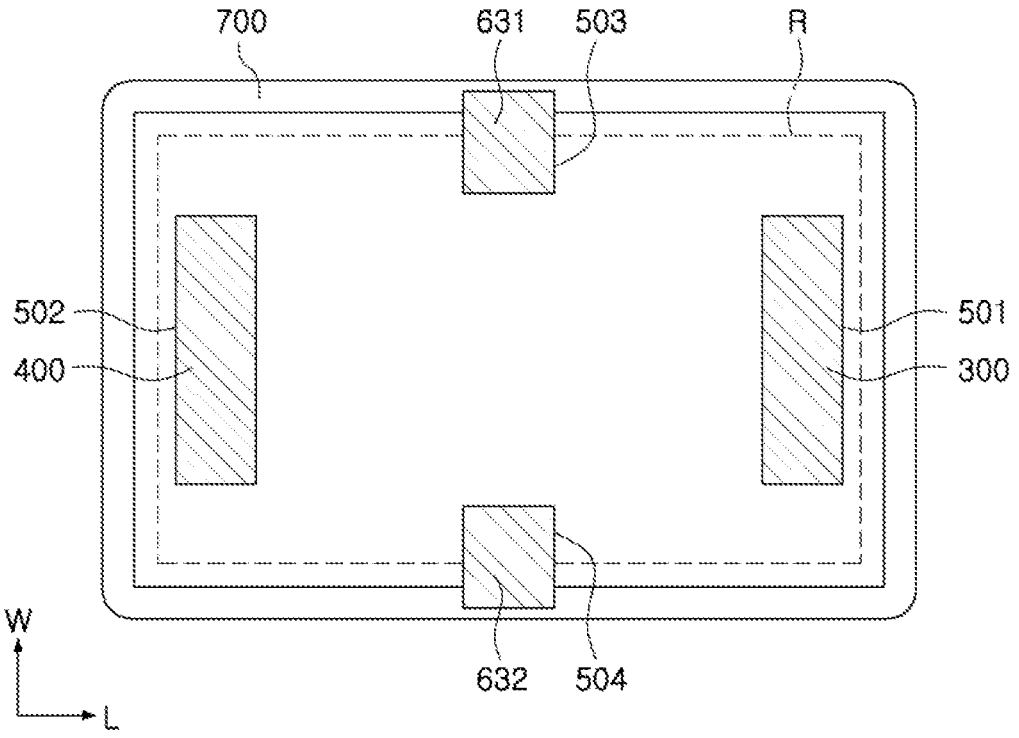
FIG. 2 is a diagram illustrating a coil component illustrated in FIG. 1, viewed from a lower portion direction.
Figure 3:
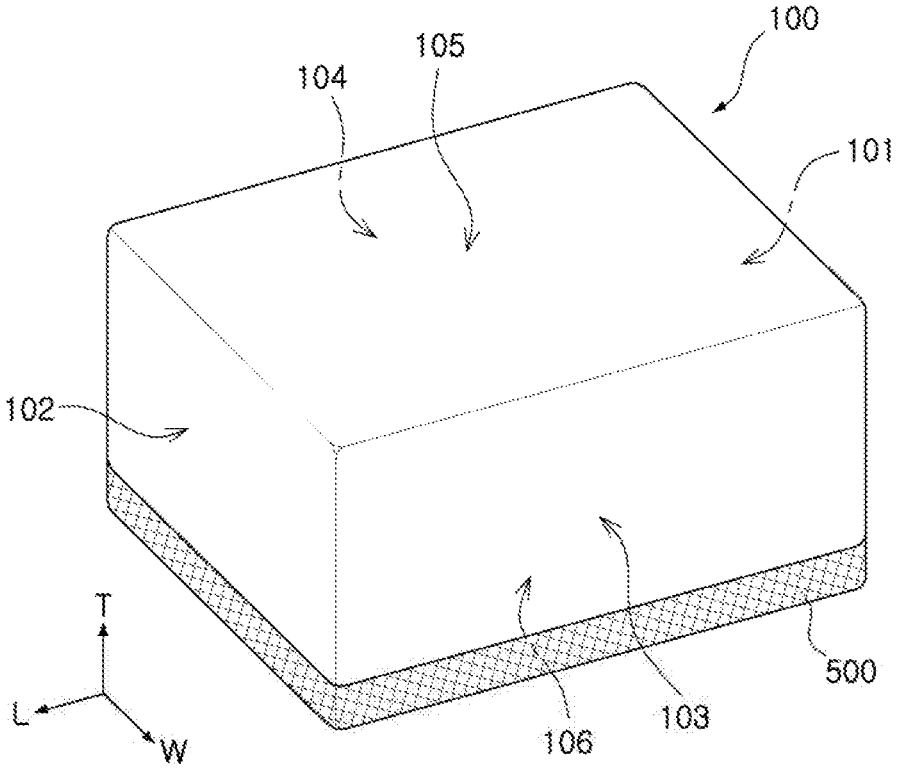
FIG. 3 is a diagram illustrating a coil component in which some elements illustrated in FIG. 1 are omitted.
Figure 4:
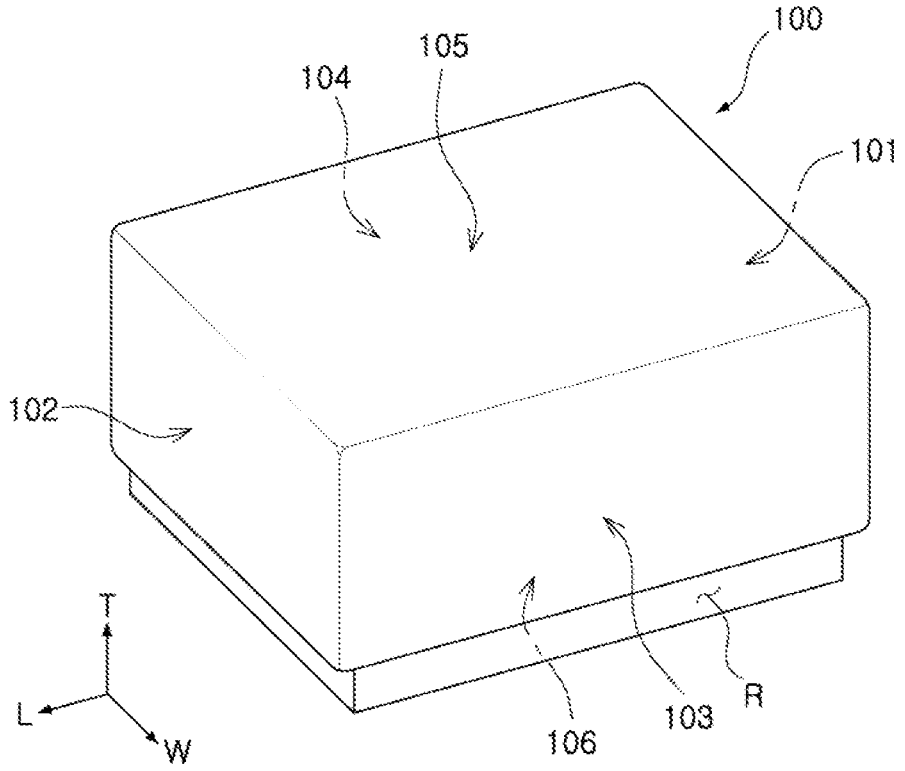
FIG. 4 is a diagram illustrating a coil component in which some elements illustrated in FIG. 3 are omitted.
Figure 5:
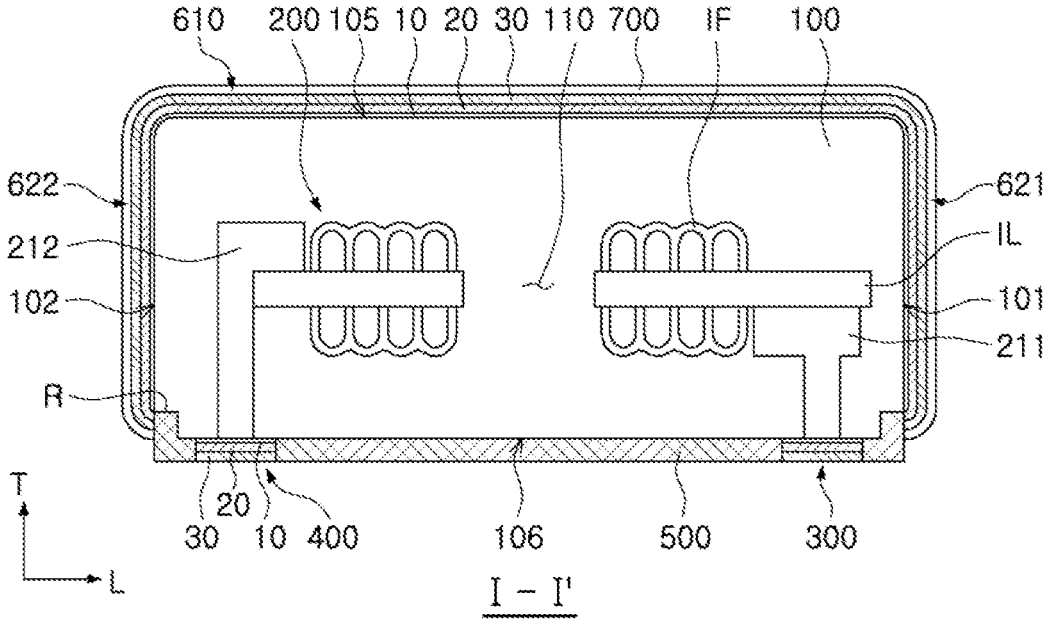
FIG. 5 is a cross-sectional diagram taken along line I-I' in FIG. 1.
Figure 6:
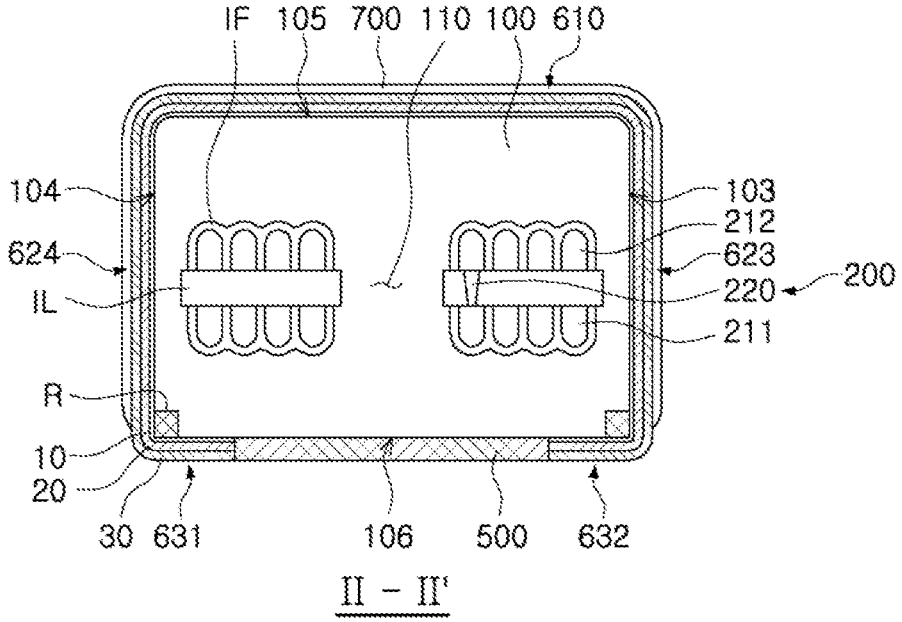
FIG. 6 is a cross-sectional diagram taken along line II-II' in FIG. 1.

FIG. 1 is a schematic diagram illustrating a coil component according to an exemplary embodiment. FIG. 2 is a diagram illustrating a coil component illustrated in FIG. 1, viewed from a lower portion direction. FIG. 3 is a diagram illustrating a coil component in which some elements illustrated in FIG. 1 are omitted. FIG. 4 is a diagram illustrating a coil component in which some elements illustrated in FIG. 3 are omitted. FIG. 5 is a cross-sectional diagram taken along line I-I' in FIG. 1. FIG. 6 is a cross-sectional diagram taken along line II-II' in FIG. 1.

FIG. 3 illustrates an example of a coil component in FIG. 1, where a shielding layer and a cover layer are omitted. FIG. 4 illustrates an example of a coil component in FIG. 3, where a lower insulating layer is omitted.

Referring to FIGS. 1 to 6, a coil component 1000 according to the exemplary embodiment may include a body 100, an internal insulating layer IL, a coil portion 200, a recess R, external electrodes 300 and 400, a lower insulating layer 500, and a shielding layer 600, and may further include a cover layer 700.

The body 100 may form an exterior of the coil component 1000, and may have the coil portion 200 buried therein.

The body 100 may have a hexahedral shape.

Referring to FIGS. 1 to 6, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body. Also, one surface and the other surface of the body 100 may refer to the sixth surface 106 and the fifth surface 105.

As an example, the body 100 may be configured such that the coil component 1000 in which the external electrodes 300 and 400, the lower insulating layer 500, the shielding layer 600, and the cover layer 700 are formed may have a length of 2.0 mm, a width of 1.2 mm, and a thickness of 0.65 mm, but an exemplary embodiment of the coil component 1000 is not limited thereto.

The body 100 may include a magnetic material and a resin material. For example, the body 110 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, a crystallinity, and a form of one magnetic materials is different from those of the other magnetic material.

The resin may include one of an epoxy, a polyimide, a liquid crystal polymer, or mixture thereof, but the example of the resin is not limited thereto.

The body 100 may include a core 110 penetrating through the coil portion 200. The core 110 may be formed by filling a through hole of the coil portion 200 with a magnetic composite sheet, but an exemplary embodiment thereof is not limited thereto.

The recess R may be formed on at least portions of edges between one surface 106 of the body 100 and the plurality of walls 101, 102, 103, and 104 of the body 100. For example, the recess R may be formed along overall edge regions formed by the first to fourth surfaces 101, 102, 103, and 104 of the body 100 and the sixth surface 106 of the body 100, but an exemplary embodiment is not limited thereto. The recess R may not extend to the fifth surface 105 of the body 100, and may be spaced away from the fifth surface 105. Thus, the recess R may not penetrate through the body 100 in a thickness direction of the body 100. The recess may take the form of a stepped edge, wherein a stepped structure is provided between an edge of the one surface 106 and an adjacent edge of each of (or one or more of) the plurality of walls 101, 102, 103, and 104 of the body 100. The stepped structure may be formed by one or more surfaces, such as planar surfaces, stepped between the edge of the one surface 106 and the adjacent edge of the one or more of the plurality of walls 101, 102, 103, and 104.

The recess R may be formed by pre-dicing a boundary (a dicing line or a singulation line) between the bodies 100 on one surface of a coil bar and forming a slit along the boundary. A width of a pre-dicing tip used in the pre-dicing may be greater than a width of a dicing line of the coil bar. The coil bar may refer to a state in which a plurality of bodies 100 are connected to each other in a length direction and a width direction of the body 100.

An internal wall of the recess R (e.g., a wall of the recess R that is parallel to one of the first to fourth surfaces 101, 102, 103, and 104) and a lower surface of the recess R (e.g., a surface of the recess that is parallel to the sixth surface 106) may also form surfaces of the body 100, but in the exemplary embodiment, the internal wall of the recess R and the lower surface of the recess R may be distinct from the first to sixth surfaces 101, 102, 103, 104, 105, and 106 of the body 100, the surfaces of the body 100, for ease of description.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs may be reduced, and a fine via may be formed.

The coil portion 200 may be buried in the body 100, and may embody properties of the coil component. For example, when the coil component 1000 is used as a power inductor, the coil portion 200 may store an electric field as a magnetic field such that an output voltage may be maintained, thereby stabilizing power of an electronic device.

The coil portion 200 may be formed on at least one of two opposing surfaces of the internal insulating layer IL, and may form at least one turn. In the exemplary embodiment, the coil portion 200 may include first and second coil patterns 211 and 212 each formed on a respective surface of the two opposing surfaces of the body 100 opposing each other in a thickness direction T of the body 100, and a via 220 may penetrate through the internal insulating layer IL to connect the first and second coil patterns 211 and 212 to each other.

The first coil pattern 211 and the second coil pattern 212 each may have a planar spiral shape forming at least one turn centered on the core 110 as an axis. For example, the first coil pattern 211 may form at least one turn centered on the core 110 as an axis on one surface of the internal insulating layer IL disposed in a lower portion in FIG. 5.

Ends of the first and second coil patterns 211 and 212 may respectively be connected to the first and second external electrodes 300 and 400. Thus, the end of the first coil pattern 211 may be connected to the first external electrode 300, and the end of the second coil pattern 212 may be connected to the second external electrode 400.

As an example, the end of the first coil pattern 211 may extend to be exposed to the sixth surface 106 of the body 100, and the end of the second coil pattern 212 may extend to be exposed to the sixth surface 106 of the body 100 such that the first and second coil patterns 211 and 212 may respectively be in contact with and connected to the first and second external electrodes 300 and 400. In this case, the coil patterns 211 and 212 including the ends exposed to the sixth surface 106 of the body 100 may be integrated with each other.

As another example, the first and second coil patterns 211 and 212 and the first and second external electrodes 300 and 400 may be connected to each other through a connection electrode. In other words, a hole may be formed to expose the ends of the first and second coil patterns 211 and 212 on the sixth surface 106 of the body 100, a connection electrode may be formed by filling the hole with a conductive material, and the first and second external electrodes 300 and 400 may be disposed on the sixth surface 106 of the body 100 to cover the connection electrode. In this case, boundaries may be formed between the coil patterns 211 and 212 and the connection electrode.

At least one of the coil patterns 211 and 212 and the via 220 may include one or more conductive layers.

For example, when the second coil pattern 212 and the via 220 are formed on the other surface of the internal insulating layer IL through a plating process, the second coil pattern 212 and the via 220 each may include a seed layer such as an electroless plating layer, and an electroplating layer. The electroplating layer may have a single-layer structure, or may have a multilayer structure. The electroplating layer having a multilayer structure may have a conformal film structure in which one of the electroplating layers is covered by the other electroplating layer, or may have a form in which one of the electroplating layers is disposed on one surface of the other plating layers. The seed layer of the second coil pattern 212 and the seed layer of the via 220 may be integrated with each other such that no boundary may be formed therebetween, but an exemplary embodiment thereof is not limited thereto. The electroplating layer of the second coil pattern 212 and the electroplating layer of the via 220 may be integrated with each other such that no boundary may be formed therebetween, but an exemplary embodiment thereof is not limited thereto.

As another example, referring to FIGS. 5 to 6, when the first coil pattern 211 disposed on a lower surface of the internal insulating layer IL, and the second coil pattern 212 disposed on an upper surface of the internal insulating layer IL are formed independently, and the coil portion 200 is formed by layering the first coil pattern 211 and the second coil pattern 212 on the internal insulating layer IL, the via 220 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generated during the layer process, and an inter-metallic compound layer (IMC layer) may be formed on at least a portion of a boundary between the metal layer having a low melting point and the second coil pattern 212 and a portion of a boundary between the metal layer having a low melting point and the metal layer having a high melting point.

As an example, the coil patterns 211 and 212 may respectively be formed on and protrude from both surfaces of the internal insulating layer IL as illustrated in FIGS. 5 and 6. As another example, the first coil pattern 211 may formed on and protrude from one surface of the internal insulating layer IL, and the second coil pattern 212 may be buried in the other surface of the internal insulating layer IL, and one surface of the second coil pattern 212 may be exposed from the other surface of the internal insulating layer IL. In this case, a concave portion may be formed on one surface of the second coil pattern 212 such that the other surface of the internal insulating layer IL may not be coplanar with one surface of the second coil pattern 212. As another example, the second coil pattern 212 may be formed on and protrude from the other surface of the internal insulating layer IL, and the first coil pattern 211 may be buried in the one surface of the internal insulating layer IL such that one surface of the first coil pattern 211 may be exposed from one surface of the internal insulating layer IL. In this case, a concave portion may be formed on one surface of the first coil pattern 211 such that one surface of the internal insulating layer IL may not be coplanar with one surface of the first coil pattern 211.

The coil patterns 211 and 212 and the via 220 each may be formed of a conductive material such as aluminum (Al), silver (Ag), tin (Sn), gold (Au), nickel (Ni), lead (Pb), titanium (Ti), or alloys thereof, but an example of the material is not limited thereto.

The lower insulating layer 500 may be disposed in the recess R and on the sixth surface 106 of the body 100. The lower insulating layer 500 may fill the recess R, and edges of the lower insulating layer 500 in the recess R may be substantially coplanar with the plurality of walls 101, 102, 103, and 104 of the body 100. For example, an insulating material for forming the lower insulating layer 500 may be formed on one surface of a coil bar on which slits are formed by the pre-dicing process described above, and a full-dicing process may be performed, and accordingly, the plurality of walls 101, 102, 103, and 104 of the body 100, isolated from one another by the full-dicing process, may substantially become coplanar with the lower insulating layer 500 that is itself cut by the dicing process.

The lower insulating layer 500 may prevent electrical shorts between the shielding layer 600 and the external electrodes 300 and 400. For example, the lower insulating layer 500 may have first and second openings 501 and 502 for forming the external electrodes 300 and 400, and the first and second openings 501 and 502 may be spaced apart from each other on the lower insulating layer 500. The openings 501 and 502 may be disposed in an inner portion with reference to the sixth surface 106 of the body such that internal walls of the openings 501 and 502 may be spaced apart from edges of the lower insulating layer 500 and may be spaced apart from and not coplanar with the plurality of walls 101, 102, 103, and 104 of the body 100. Thus, overall side surfaces of the first and second external electrodes 300 and 400 formed in the openings 501 and 502 may be covered by the lower insulating layer 500, thereby preventing electrical shorts between the shielding layer 600 and the first and second external electrodes 300 and 400.

The lower insulating layer 500 may further include third and fourth openings 503 and 504 respectively being spaced apart from the first and second openings 501 and 502. The third and fourth openings 503 and 504 may have ground electrodes 631 and 632 disposed therein.

The lower insulating layer 500 may include a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and SiOx or SiNx.

The lower insulating layer 500 may be formed by applying a liquid insulating resin to the sixth surface 106 of the body 100, by layering an insulating film such as a dry film (DF) on the sixth surface 106 of the body 100, or by forming an insulating material on the sixth surface 106 of the body 100 through a thin film process such as a vapor deposition process. When an insulating film is used, an Ajinomoto Build-up Film (ABF) which does not include a photosensitive insulating resin, or a polyimide film may be used.

The lower insulating layer 500 disposed on the sixth surface 106 of the body 100 may have a thickness of 10 nm to 100 μm. When a thickness of the lower insulating layer 500 is less than 10 nm, properties of the coil component such as a Q factor, and the like, may be reduced, and when a thickness of the lower insulating layer 500 is greater than 100 μm, an overall length, width, and thickness of the coil component may increase such that it may be difficult to reduce a size of the coil component.

A width and a thickness of the lower insulating layer 500 disposed in the recess R may be determined depending on a width of the pre-dicing tip and a width of the full-dicing tip described above.

The external electrodes 300 and 400 may penetrate through the lower insulating layer 500, may be disposed or exposed on the sixth surface 106 of the body 100 and spaced apart from each other, and may be connected to the coil portion. For example, the first external electrode 300 may be disposed in the first opening 501 of the lower insulating layer 500 and may be connected to an end of the first coil pattern 211, and the second external electrode 400 may be disposed in the second opening 502 of the lower insulating layer 500 and may be connected to an end of the second coil pattern 212.

The external electrodes 300 and 400 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The external electrodes 300 and 400 may be formed of a single layer or multiple layers. For example, the external electrodes 300 and 400 each may include a first layer 10 including copper (Cu), a second layer 20 including nickel (Ni), and a third layer 30 including tin (Sn).

The shielding layer 600 may be disposed on the fifth surface 105 of the body 100 and the plurality of walls 101, 102, 103, and 104 of the body 100, and at least a portion of the shielding layer 600 may extend to the one surface 106 of the body 100 and may be spaced apart from the first and second external electrodes 300 and 400. In the exemplary embodiment, the shielding layer 600 may include a cap portion 610 disposed on the fifth surface 105 of the body 100, first to fourth side wall portions 621, 622, 623, and 624 respectively disposed on the first to fourth surfaces 101, 102, 103, and 104 of the body 100, and the ground electrodes 631 and 632 extending respectively from the third and fourth side wall portions to the sixth surface of the body 100. With regard to the ground electrodes 631 and 632, when the coil component 1000 in the exemplary embodiment is mounted on a printed circuit board, and the like, the ground electrodes 631 and 632 may be electrically connected to a ground layer of the printed circuit board.

The shielding layer 600 may be disposed on surfaces of the body 100 other than the sixth surface 106 of the body 100, and may reduce a magnetic flux leakage of the coil component 1000. In one example, the ground electrodes 631 and 632 are the only portion of the shielding layer 600 that extends on to the sixth surface 106 of the body 100.

One end of each of the first to fourth side wall portions 621, 622, 623, and 624 may be connected to the cap portion 610, and another end of each of the first to fourth side wall portions 621, 622, 623, and 624 may extend adjacently to (but not extend onto) the sixth surface 106 of the body 100. As the other ends of the first to fourth side wall portions 621, 622, 623, and 624 do not extend onto the sixth surface 106 of the body 100, electrical shorts between the shielding layer 600 and the first and second external electrodes 300 and 400 may be prevented.

The cap portion 610, the first to fourth side wall portions 621, 622, 623, and 624, and the ground electrodes 631 and 632 may be integrated with one another. The cap portion 610 and the first to fourth side wall portions 621, 622, 623, and 624 may be formed in the same process such that no boundaries may be formed between the cap portion 610 and the first to fourth side wall portions 621, 622, 623, and 624. For example, the cap portion 610 and the first to fourth side wall portions 621, 622, 623, and 624 may be integrated with each other by performing a vapor deposition process such as a sputtering process to the first to fifth surfaces 101, 102, 103, 104, and 105 of the body 100. Alternatively, the cap portion 610 and the first to fourth side wall portions 621, 622, 623, and 624 may be integrated with each other by performing an electroplating process to the first to fifth surfaces 101, 102, 103, 104, and 105 of the body 100. When the shielding layer 600 is provided as a plurality of layers, the layers of the shielding layer 600 may be integrated in regions corresponding to the cap portion 610, the first to fourth side wall portions 621, 622, 623, and 624, and the ground electrodes 631 and 632. Thus, when the shielding layer 600 including the ground electrodes 631 and 632, and the first and second external electrodes 300 and 400 are formed in the body 100, the lower insulating layer 500 may function as a mask such that the shielding layer 600 and the first and second external electrodes 300 and 400 may be formed on only certain regions of the body 100.

The shielding layer 600 may include at least one of a conductive material and a magnetic material. For example, the conductive material may be a metal or an alloy including one or more selected from a group consisting of copper (Cu), aluminum (Al), iron (Fe), silicon (Si), boron (B), chromium (Cr), niobium (Nb), and nickel (Ni), or may be Fe—Si or Fe—Ni. Also, the shielding layer 600 may include one or more materials selected from a group consisting of a ferrite, a permalloy, and an amorphous ribbon.

The shielding layer 600 may have a plurality of layers. In the exemplary embodiment, the shielding layer 600 and the first and second external electrodes 300 and 400 may be formed through the same process. In other words, similarly to the first and second external electrodes 300 and 400, the shielding layer 600 may include a first layer 10 including copper (Cu), a second layer 20 including nickel (Ni), and a third layer 30 including tin (Sn).

The shielding layer 600 may have a thickness of 10 nm to 100 μm. When a thickness of the shielding layer 600 is less than 10 nm, no or limited shielding effect may be implemented, and when a thickness of the shielding layer 600 is greater than 100 μm, an overall length, width, and thickness of the coil component may increase such that it may be difficult to reduce a size of the coil component.

The cover layer 700 may be disposed on the shielding layer 600 to cover the shielding layer 600, and may be in contact with the lower insulating layer 500. In other words, the cover layer 700 may bury the shielding layer 600 in the cover layer 700 along with the lower insulating layer 500. Thus, the cover layer 700 may be disposed on the first to fifth surfaces 101, 102, 103, 104, and 105 of the body 100 similarly to the lower insulating layer 500. The cover layer 700 may prevent the shielding layer 600 from being electrically connected to external electronic components. The ground electrodes 631 and 632 may not be covered by (e.g., may be free of) the cover layer 700.

The cover layer 700 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and SiOx or SiNx.

The cover layer 700 may be formed by layering a cover film such as a dry firm DF on the body 100 on which the shielding layer 600 is formed. Alternatively, the cover layer 700 may be formed by forming an insulating material on the body 100 on which the shielding layer 600 is formed through a vapor deposition process such as a chemical vapor deposition (CVD) process, and the like.

The cover layer 700 may a thickness of 10 nm to 100 μm. When a thickness of the cover layer 700 is less than 10 nm, insulating properties may be weakened such that electrical shorts may occur between the shielding layer 600 and external electronic components, and when a thickness of the cover layer 700 is greater than 100 μm, an overall length, width, and thickness of the coil component may increase such that it may be difficult to reduce a size of the coil component.

A sum of thicknesses of the shielding layer 600 and the cover layer 700 may be greater than 30 nm, and may be 100 μm or lower. When a sum of thicknesses of the shielding layer 600 and the cover layer 700 is less than 30 nm, the issues such as electrical shorts, reduction of properties of a coil component such as a Q factor, and the like, may occur. When a sum of thicknesses of the shielding layer 600 and the cover layer 700 is greater than 100 ρm, an overall length, width, and thickness of the coil component may increase, and it may be difficult to reduce a size of the coil component.

An insulating film IF may be formed along surfaces of the coil patterns 211 and 212 and the internal insulating layer IL. The insulating film IF may insulate the coil patterns 211 and 212 from the body 100, and may include an insulating material such as a parylene, and the like. An insulating material included in the insulating film IF may not be limited to any particular material. The insulating film IF may be formed through a vapor deposition process, and the like, but the method of forming the insulating film IF is not limited thereto. The insulating film IF may also be formed by layering an insulating film on both surfaces of the internal insulating layer IL.

Also, in the exemplary embodiment, the coil component 1000 may further include an additional insulating layer distinct from the lower insulating layer 500 and formed on and being in contact with at least one of the first to fifth surfaces 101, 102, 103, 104, and 105 of the body 100. The additional insulating layer may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx.

The lower insulating layer 500 and the cover layer 700 may be directly disposed in the coil component, and may thus be different from a molding material molding the coil component and a printed circuit board during a process of mounting the coil component on the printed circuit board. For example, the lower insulating layer 500 and the cover layer 700 may not be formed on a region other than a mounting region of a printed circuit board, differently from a molding material. Also, the lower insulating layer 500 and the cover layer 700 may not be supported by or fixed to a printed circuit board, differently from a molding material. Further, differently from a molding material surrounding a connection member such as a solder ball which connects a coil component to a printed circuit substrate, the lower insulating layer 500 and the cover layer 700 may not surround a connection member. Also, the lower insulating layer 500 and the cover layer 700 are not molding materials formed by heating an epoxy molding compound, and the like, flowing the heated epoxy molding compound onto a printed circuit board, and performing a curing process, it may not be necessary to consider a void occurring during a process of forming a molding material, or warpage of a printed circuit board caused by a difference in coefficients of thermal expansion between a molding material and a printed circuit board.

Also, the shielding layer 600 may be directly disposed in the coil component in the exemplary embodiment, and thus, the shielding layer 600 may be different from a shielding can, which is coupled to a printed circuit board to shield EMI, and the like, after mounting the coil component on a printed circuit board. For example, as the shielding layer 600 is directly formed in the coil component, when the coil component is coupled to the printed circuit board by a solder, and the like, the shielding layer 600 may also be fixed to the printed circuit board. However, a shielding can may need to be fixed to a printed circuit board independently of the coil component.

Accordingly, in the coil component 1000 in the exemplary embodiment, by the shielding layer 600 being directly formed in the component, a magnetic flux leakage occurring in the coil component 1000 may be shielded effectively. In other words, as electronic devices are reduced in size and have higher performances, the number of electronic components included in an electronic device have been increased, and a distance between adjacent electronic components have been reduced. In the exemplary embodiment, by shielding the coil component 1000, a magnetic flux leakage occurring in the coil component 1000 may be shielded effectively, thereby reducing a size of an electronic device and improving a performance of an electronic device. Further, in the coil component 1000 in the exemplary embodiment, the amount of an effective magnetic material may be increased in a shield region as compared to a configuration in which a shielding can is used, thereby improving properties of the coil component.

Also, in the coil component 1000 in the exemplary embodiment, an electrode structure may easily be implemented on a lower portion while substantially maintaining sizes of components. In other words, differently from the related art, the external electrodes 300 and 400 may not be disposed on the first and second surfaces 101 and 102 or on the third and fourth surfaces 103 and 104 of the body 100, and thus, increases of a length and a width of the coil component 1000 caused by the shielding layer 600 and the cover layer 700 may be alleviated to some extent. Further, as the external electrodes 300 and 400 have relatively reduced thicknesses, an overall width and length of the coil component 100 may be reduced.

In addition, in the coil component 1000 in the exemplary embodiment, by the recess R and the lower insulating layer 500, electrical shorts may be prevented between the external electrodes 300 and 400 formed on the sixth surface 106 of the body 100 and the shielding layer 600 formed on the first to fifth surfaces 101, 102, 103, 104, and 105 of the body 100. In other words, by forming the recess Ron at least portions of edges between the sixth surface 106 of the body 100 and the first to fifth surfaces 101, 102, 103, 104, and 105 of the body 100 and disposing the lower insulating layer 500 in the recess R, an insulating distance between the external electrodes 300 and 400 and the shielding layer 600 may be increased.

According to the aforementioned exemplary embodiment, a size of a coil component may be reduced.

Also, an electrode structure on a lower surface may easily be formed.

Further, a shielding structure may easily be formed.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having one surface and another surface opposing each other in one direction, and a plurality of walls each connecting the one surface to the another surface of the body;

an internal insulating layer disposed within the body;

a coil portion disposed on at least one of two opposing surfaces of the internal insulating layer, and forming at least one turn;

a recess extending along at least portions of edges common to the one surface of the body and to walls of the plurality of walls of the body;

a lower insulating layer disposed in the recess and on the one surface of the body;

first and second external electrodes penetrating through the lower insulating layer, disposed on the one surface of the body and spaced apart from each other, and connected to the coil portion; and a shielding layer disposed on the another surface of the body and the plurality of walls of the body, and having at least a portion extending to the one surface of the body and being spaced apart from the first and second external electrodes, wherein the lower insulating layer is arranged between at least one of the first or second external electrode and the shielding layer along a path from the one surface to a wall among the plurality of walls.

2. The coil component of claim 1, wherein the shielding layer includes a plurality of metal layers.

3. The coil component of claim 1, wherein the shielding layer, the first external electrode, and the second external electrode each include a plurality of metal layers.

4. The coil component of claim 3, wherein the shielding layer, the first external electrode, and the second external electrode each include a first layer including copper (Cu), a second layer including nickel (Ni), and a third layer including tin (Sn).

5. The coil component of claim 1, wherein the plurality of walls of the body include opposing front and rear surfaces, and side surfaces connecting the front and rear surfaces, wherein the shielding layer includes a cap portion disposed on the other surface of the body, first and second side wall portions disposed on the front and rear surfaces of the body respectively, and third and fourth side wall portions disposed on respective side surfaces of the body, and wherein at least portions of the third and fourth side wall portions extend onto the lower insulating layer.

6. The coil component of claim 1, wherein the lower insulating layer fills the recess, and edges of the lower insulating layer in the recess are substantially coplanar with the plurality of walls of the body.

7. The coil component of claim 1, further comprising:

a cover layer disposed on the shielding layer.

8. The coil component of claim 1, wherein the first and second external electrodes each have side surfaces covered by the lower insulating layer.

9. The coil component of claim 1, wherein opposing ends of the coil portion extend to the one surface of the body in the one direction and are connected to the first and second external electrodes.

10. The coil component of claim 1, further comprising:

a connection electrode penetrating through the body to connect opposing ends of the coil portion and the first and second external electrodes.

11. A coil component comprising:

a body including a magnetic material, and having a coil disposed therein, the body having a mounting surface, a plurality of side walls, and a stepped edge between the mounting surface and at least one of the plurality of side walls;

an insulating layer disposed on the mounting surface and extending into the stepped edge between the mounting surface and the at least one of the plurality of side walls; and first and second external electrodes disposed on the mounting surface, extending through the insulating layer, and connected to opposing ends of the coil, wherein the insulating layer is arranged between at least one of the first or second external electrode and the at least one of the plurality of side walls along a path from the mounting surface to the at least one of the plurality of side walls.

12. The coil component of claim 11, further comprising:

a conductive shielding layer disposed on a cap surface of the body opposite to the mounting surface and on the plurality of side walls of the body, and contacting the insulating layer.

13. The coil component of claim 12, wherein side surfaces of the insulating layer are coplanar with the side walls of the body, and the conductive shielding layer extends on to the side surfaces of the insulating layer.

14. The coil component of claim 12, further comprising:

a ground electrode disposed on the mounting surface to be spaced apart from the first and second external electrodes, extending through the insulating layer, and extending across the stepped edge of the body to contact the conductive shielding layer.

15. The coil component of claim 14, wherein the first and second external electrodes are spaced apart from the stepped edge, and the insulating layer extends between each of the first and second external electrodes and the stepped edge of the body.

16. The coil component of claim 12, wherein an external surface of the insulating layer, disposed opposite to a surface of the insulating layer facing the mounting surface, is free of the conductive shielding layer.

* * * * *